US006106279A

United States Patent [19]

Hedlund

[11] Patent Number: 6,106,279

[45] Date of Patent: Aug. 22, 2000

[54] CANDLE HOLDER FOR JACK-O-LANTERN

[76] Inventor: Rodger R. Hedlund, 3993 Orion Rd., Oakland Township, Mich. 48363

[21] Appl. No.: 09/124,667

[22] Filed: Jul. 29, 1998

[51] Int. Cl.[7] ..... F23D 13/16

[52] U.S. Cl. ..... 431/294; 431/292

[58] Field of Search ..... 431/292, 294, 431/293, 296, 297, 126; D26/6, 9, 12, 20, 22; 362/161, 162, 163, 410, 415, 190, 191, 180, 181; 248/156, 158

[56] References Cited

U.S. PATENT DOCUMENTS

| | | | |
|---|---|---|---|
| D. 72,688 | 5/1927 | West . | |
| D. 105,445 | 7/1937 | Traum . | |
| D. 396,119 | 7/1998 | Allison . | |
| 501,877 | 7/1893 | Dobelin . | |
| 915,595 | 3/1909 | Hamm . | |
| 1,761,299 | 6/1930 | Heisey | 431/289 |
| 2,241,698 | 5/1941 | Brady . | |
| 3,843,079 | 10/1974 | Reisling . | |
| 3,932,113 | 1/1976 | Thrush . | |
| 4,224,017 | 9/1980 | Kayne . | |
| 4,544,351 | 10/1985 | Marsicano . | |
| 4,759,699 | 7/1988 | Rubarth . | |
| 4,955,807 | 9/1990 | Chance et al. . | |
| 5,651,669 | 7/1997 | Henry | 431/297 |

*Primary Examiner*—Carl D. Price
*Attorney, Agent, or Firm*—Harness, Dickey & Pierce, P.L.C.

[57] ABSTRACT

A candle holder is provided including a generally hemispherical shaped base member including a centrally disposed candle mounting portion for receiving the base of a candle. An arcuately shaped circumferential side wall projects from the candle mounting portion to a terminal end axially and radially spaced apart therefrom. The side wall is subdivided by a plurality of concave seams into a plurality of bulging segments. A plurality of axially extending tabs project from the side wall so as to extend opposite the candle mounting portion for engaging with the bottom or bloom point of a pumpkin or other substrate.

17 Claims, 1 Drawing Sheet

CANDLE HOLDER FOR JACK-O-LANTERN

BACKGROUND OF THE INVENTION

1. Technical Field

The present invention relates generally to devices for anchoring candles within substrates, and more particularly, to a candle holder for holding a candle within a hollowed-out pumpkin, or jack-o-lantern.

2. Discussion

The inside bottom of a hollowed-out pumpkin has a vertically protruding hump or mound known as the bloom point which makes it difficult to securely fix a candle at that spot. Candles have been fixed to the bottom of jack-o-lanterns by a number of methods, however, these methods generally tend to be unsuccessful or unsatisfactory in one way or another. For instance, one method involves placing a candle in a sufficient quantity of melted wax on the bottom of the pumpkin so that the candle will become secured to the bottom when the wax hardens. Alternatively, the candle can be secured in melted wax dripped onto a dish or plate which is then placed at the bottom of the pumpkin on the bloom point. However, both of these methods are unsatisfactory since the candles tend to become unsecured if the pumpkin is moved or if the wax securing the candles melts or softens from the heat produced by the candle flame.

Another method for securing a candle within a jack-o-lantern is disclosed in U.S. Pat. No. 4,955,807 to Chance, et al. issued Sep. 11, 1990. Chance discloses the use of a spiral coil candle holder which is imbedded into a jack-o-lantern in a corkscrew-like manner. While the Chance device overcomes some of the drawbacks of the wax methods described above, there is still room for improvement in the art. For instance, it would be desirable to provide a candle holder having a broader base such that the candle will be isolated from torque forces generated when moving the jack-o-lantern. Also, it would be desirable to provide a more convenient means for imbedding the candle holder within the jack-o-lantern than the corkscrew-type motion describe above.

It should, therefore, be appreciated that there is a need for a candle holder which aids in overcoming the above problems and can securely anchor candles to the bottom or bloom point of a pumpkin or other substrate. The present invention provides the necessary solution.

SUMMARY OF THE INVENTION

The above and other objects are provided by a candle holder including a dome-like or hemispherical shaped base member including a centrally located candle mounting portion for receiving the lower end of a candle. The candle mounting portion includes a recessed annular lip for capturing melting wax from the candle. An arcuately shaped circumferential side wall of the base projects upwardly from the candle mounting portion and downwardly along a curved path to a generally circularly shaped terminal end axially and radially spaced apart therefrom. The side wall is subdivided by a plurality of concave seams such that the side wall includes a plurality of bulging segments emulating the configuration of a pumpkin thereby defining wax drain channels between adjacent segments. A plurality of axially extending anchors project from the side wall so as to extend opposite the candle mounting portion for engaging with the bottom or bloom point of a pumpkin or other substrate. When used in its preferred environment, the hollow interior volume of the candle holder below the candle mounting portion and within the side wall accommodates the vertically protruding hump or mound within the pumpkin known as the bloom point.

As a further feature of the present invention, the candle holder is made of metal having high heat transfer characteristics which is not destroyed or deformed by the heat generated from the flames of the candle.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENTS

The present invention is directed towards a candle holder which is generally semispherically shaped thereby providing a broad base for isolating a candle mounted thereto from tortional influences. The candle holder is provided with a hollow interior so as to accommodate the bloom point on the bottom of a pumpkin. Also, the candle holder is preferably made from a metal formed into shape using a stamp or die. As such, the candle holder is resistant to heat influences from the candle. Alternatively, the candle holder may be molded from a heat resistant polymer.

Figure 1:
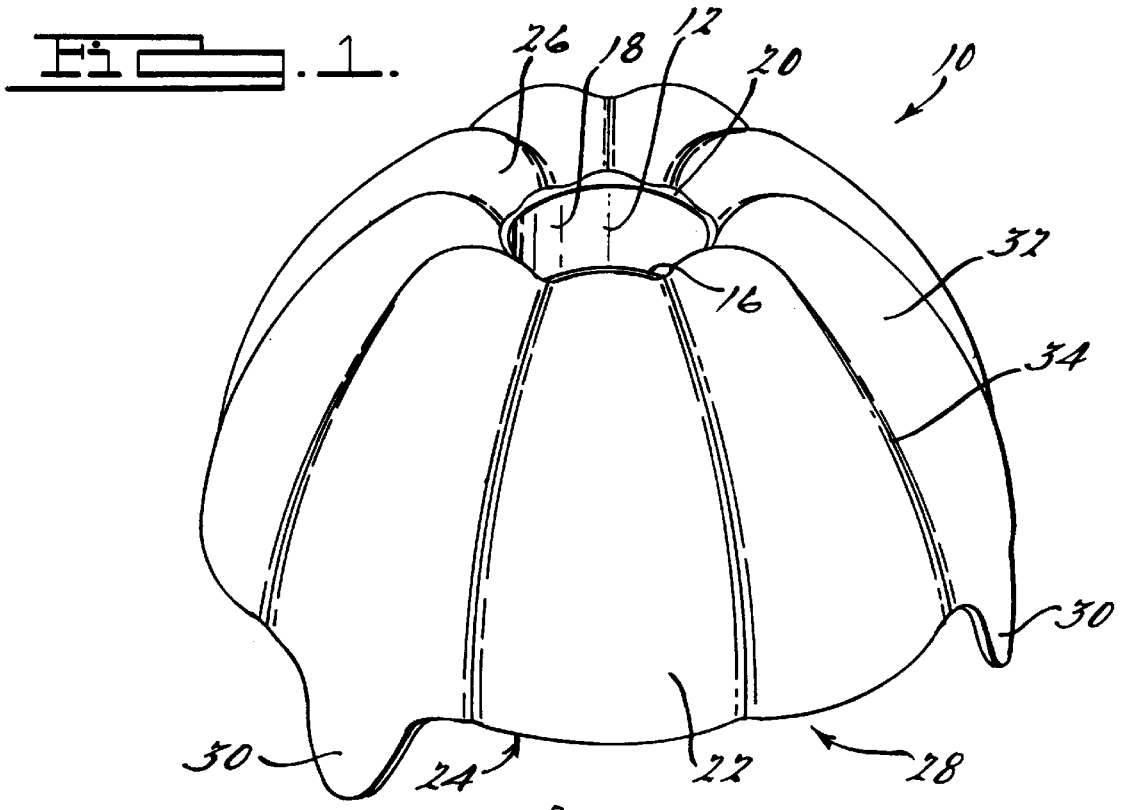
FIG. 1 is a top perspective view of the candle holder of the present invention.
Figure 2:
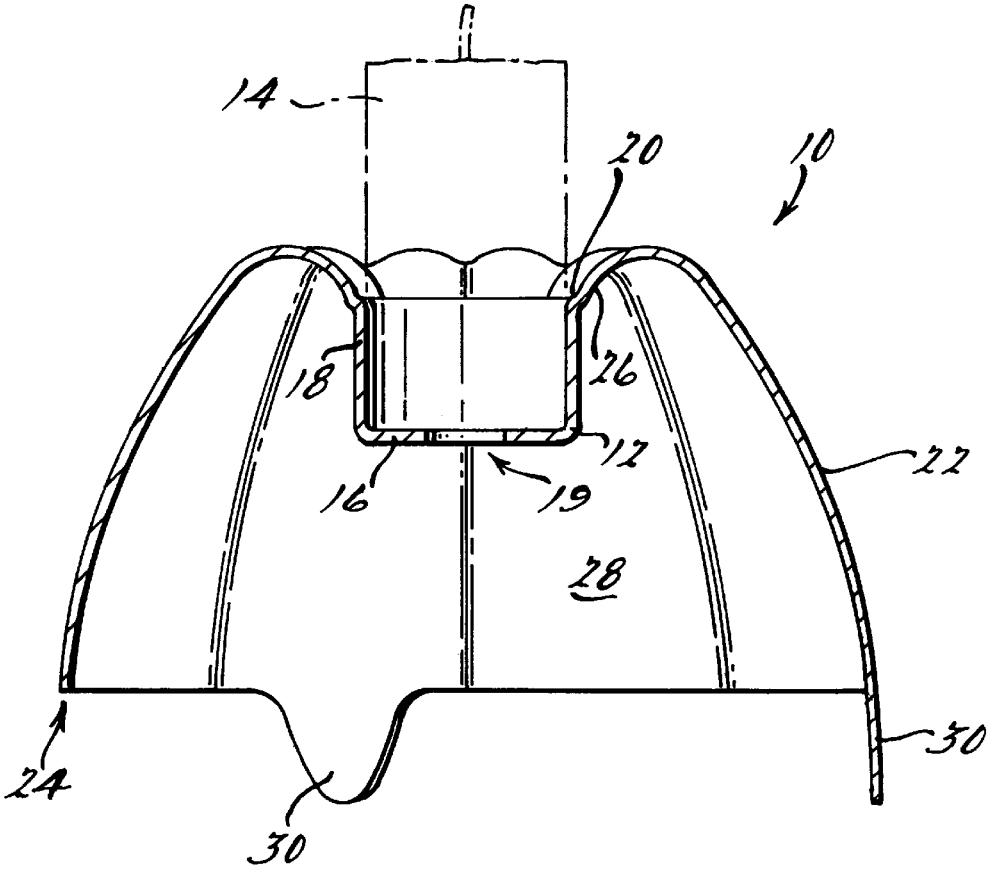
FIG. 2 is a cross-sectional view of the candle holder of FIG. 1.

Referring now to FIGS. 1 and 2, the candle holder 10 includes a centrally disposed, cup-shaped candle mounting portion 12 for supporting the lower end of a candle 14. The candle mounting portion 12 is preferably shaped as a hollow cylinder but may be formed to any desired shape to compliment the external surface of a candle to be secured therein. Also, the candle mounting portion 12 may include inwardly tapered side walls so as to accommodate candles having different diameters. Alternatively, a biasing or wedging means such as a spring tab (not illustrated) may be incorporated within the candle mounting portion 12 to provide a means of securing variably sized candles therein.

As illustrated, the candle mounting portion 12 includes a base 16 supporting the bottom of the candle 14 and a cylindrical side mounting wall 18 extending upwardly from the base 16 and encircling the side surface of the candle 14. The base 16 includes a central opening or orifice 19 for enabling a user to displace a lodged candle from the candle mounting portion 12 by applying a force to the bottom of the candle 14 through the orifice 19. The cylindrical mounting wall 18 terminates in a recessed lip 20 of the candle mounting portion 12. The lip 20 is preferably formed along a horizontal plane essentially parallel to the base 16.

An arcuately shaped side wall 22 extends from the lip 20 to a generally circularly shaped scalloped terminal end 24. As best seen in FIG. 2, the side wall 22 preferably projects upwardly from the lip 20 prior to cresting in an arc and then curving downwardly toward the terminal end 24. As such, the upwardly projecting portion 26 of the side wall 22 flares out from the lip 20 to form a cone or basin for capturing and directing melted candle wax from the candle 14 towards the candle mounting portion 12.

The curved shape of the side wall 22 spaces the terminal end 24 axially and radially away from the candle mounting portion 12 so as to define a hollow inner volume 28 of the candle holder 10. The diameter of the terminal end 24 is preferably chosen so as to accommodate typical bloom points within pumpkins and to provide a broad base for supporting the candle 14. Similarly, the height of the side wall 22 is selected so as to provide sufficient space under the candle mounting portion 12 for the bloom point.

A plurality of circumferentially spaced-apart anchors or tabs 30 axially extend from the side wall 22 so as to project opposite the candle mounting portion 12 and candle 14. While tabs are illustrated, one skilled in the art will recognize that a plurality of posts could substitute therefore. Preferably, the tabs 30 are integrally formed with the sidewall 22 along the terminal end 24. Further, each tab 30 is preferably tapered at least at its tip or distal end so as to enable each tab 30 to be embedded into the bottom of a pumpkin or other substrate upon receiving an applied pressure. While any number of tabs 30 may be employed with the candle holder 10 of the present invention, it is presently preferred to use a minimum of three, equidistantly spaced tabs 30 to insure secure engagement of the candle holder 10 with the pumpkin. It is also preferred that the tabs 30 be made from the same metallic material as the remainder of the candle holder 10 such that the entire candle holder 10 may be formed in a single step.

As best seen in FIG. 1, the side wall 22 is subdivided into a plurality of bulging segments 32 by a number of concave seams 34. The seams 34 provide a channel between adjacent segments 32 for capturing and directing errant wax drippings from the candle 14 which may result from swirling wind or when moving the pumpkin or candle holder 10. As such, the candle holder 10 is kept generally neat and clean in appearance. The seams 34 also function to shape the side wall 22 such that it compliments the shape of the pumpkin into which it is preferably inserted.

Thus, as opposed to prior art candle holders, the present invention provides a broad base for stably supporting the candle. The present invention also provides a simple means by which to embed the candle holder into the bottom of a pumpkin or other substrate. The hollow interior of the candle holder enables it to accommodate the bloom point of a pumpkin. Further, the flared out and conical shape of the candle holder proximate the candle mounting portion funnels melting wax to a pre-selected location adjacent the candle base. Any melting wax landing outside of this conical portion is captured and directed by concave seams such that the candle holder maintains a clean appearance.

Those skilled in the art can now appreciate from the foregoing description that the broad teachings of the present invention can be implemented in a variety of forms. For instance, the angle of curvature of the side wall may be varied to yield different shaped holders. Therefore, while this invention has been described in connection with a particular example thereof, the true scope of the invention should not be so limited since other modifications will become apparent to the skilled practitioner upon a study of the drawings, specification, and following claims.

What is claimed is:

1. A candle holder comprising:

a cup-like shaped candle mounting portion including a lip at a top surface thereof;

a side wall circumferentially extending upwardly from said lip along a convex curve to a crest thereby defining a wax basin between said lip and said crest, said side wall continuing downwardly at an angle from said crest to a radially and axially spaced apart terminal end; and a plurality of concave seams extending over said crest between said lip and said terminal end so as to subdivide said side wall into a plurality of bulging segments such that melted wax accumulating in said wax basin is directed over said crest and along said side wall by said concave seams.

2. The candle holder of claim 1 wherein said candle mounting portion and side wall form a hollow interior for accommodating upwardly projecting substrate material thereunder.

3. The candle holder of claim 1 wherein said side wall extends along a curve from said candle mounting portion toward said terminal end.

4. The candle holder of claim 1 wherein said plurality of bulging segments of said side wall extend about a perimeter of said wax basin between said lip of said candle holder portion and said crest.

5. The candle holder of claim 1 wherein said candle mounting portion further comprises a base and a cylindrical wall extending upwardly from said base.

6. The candle holder of claim 1 further comprising a plurality of anchors projecting from said side wall.

7. The candle mounting of claim 6 wherein said anchors project axially away from said terminal end of said side wall opposite said candle holder portion.

8. The candle holder of claim 6 wherein said anchors are tapered at least at a distal end thereof.

9. The candle holder of claim 6 wherein said anchors are equidistantly spaced about said side wall.

10. A candle holder for supporting a candle within a hollowed-out pumpkin comprising:

a cylindrical candle mounting portion including a lip at an upper surface thereof;

an arcuate side wall circumferentially projecting from said lip of said candle mounting portion upwardly along a convex curve to a crest to form a wax basin between said lip and said crest, said side wall angling downwardly along a curve from said crest to a terminal end axially and radially spaced apart from said candle mounting portion;

a plurality of concave seams extending over said crest between said lip and said terminal end so as to subdivide said side wall into a plurality of bulging arcuate segments for directing melted wax accumulating in said wax basin over said crest and along said side wall in a pre-selected manner by way of said concave seams; and a plurality of tabs axially projecting away from said side wall opposite said candle mounting portion.

11. The candle holder of claim 10 wherein said side wall forms a hollow interior so as to support said candle mounting portion spaced apart from a substrate such that a raised portion of said substrate may be accommodated thereunder.

12. The candle holder of claim 10 wherein said plurality of bulging segments of said side wall extend about a perimeter of said wax basin between said lip of said candle mounting portion and said crest.

13. The candle holder of claim 10 wherein said tabs are tapered toward a distal end.

14. The candle holder of claim 10 wherein said candle holder is formed of a metallic material.

15. A candle holder for supporting a candle within a jack-o-lantern while accommodating a bloom point thereof comprising:

a centrally disposed cylindrical candle mounting portion including a base, a cylindrical mounting wall extending upwardly from said base and an annular lip atop said mounting wall;

a side wall circumferentially extending upwardly alone a convex curve from said lip to an arcuate crest thereby forming a wax basin between said lip and said crest, said side wall projecting downwardly and outwardly from said crest along a convex curve to a terminal end radially and axially spaced apart from said candle mounting portion;

a plurality of concave seams extending over said crest between said lip and said terminal end so as to subdivide said wax basin and a remainder of said side wail into a plurality of convex arcuate segments, said concave seams directing melted wax accumulating in said wax basin over said crest and along side wall in a pre-selected manner; and a plurality of tapered tabs extending axially away from said side wall opposite said candle mounting portion.

16. The candle holder of claim 15 wherein said tabs are equidistantly spaced about an interior of said side wall.

17. The candle holder of claim 15 wherein said candle mounting portion includes a variable diameter so as to accommodate different sized candles.

* * * * *